US007258324B2

(12) United States Patent
Gilman

(10) Patent No.: US 7,258,324 B2
(45) Date of Patent: Aug. 21, 2007

(54) RATCHETING WINCH WITH A MAGNETICALLY BIASED PAWL

(76) Inventor: Jeffry S. Gilman, 241 White Pond Rd., Hudson, MA (US) 01749

( * ) Notice: Subject to any disclaimer, the term of this patent is extended or adjusted under 35 U.S.C. 154(b) by 70 days.

(21) Appl. No.: 11/239,538

(22) Filed: Sep. 29, 2005

(65) Prior Publication Data

US 2006/0169957 A1 Aug. 3, 2006

Related U.S. Application Data

(60) Provisional application No. 60/614,936, filed on Sep. 30, 2004.

(51) Int. Cl.
*B21F 9/00* (2006.01)
*B66F 3/00* (2006.01)

(52) U.S. Cl. ..... 254/222; 254/223; 254/247; 192/223.1

(58) Field of Classification Search ..... 254/222, 254/223, 247, 376, 217, 369; 192/223.1, 192/84.3

See application file for complete search history.

(56) References Cited

U.S. PATENT DOCUMENTS 6,095,300 A * 8/2000 .ANG.hs ..... 192/44
6,186,429 B1 * 2/2001 Cockerham ..... 242/231
6,824,121 B2 * 11/2004 Boice ..... 254/223
6,966,543 B2 * 11/2005 Loudamy ..... 254/243
2003/0057047 A1 * 3/2003 Jin ..... 192/46

* cited by examiner

*Primary Examiner*—Gene O. Crawford
*Assistant Examiner*—Evan Langdon
(74) *Attorney, Agent, or Firm*—Kriegsman & Kriegsman

(57) ABSTRACT

A winch for controlling the tautness of a length of wire includes a generally U-shaped frame and a spindle rotatably mounted on the frame, the spindle serving as a spool on which the length of wire can be wound. The winch additionally includes a ratchet rotatably mounted on the frame in co-axial alignment with the spindle, the ratchet being fixedly connected to one end of the spindle using the combination of a threaded bolt and a washer. Furthermore, the winch includes a pawl pivotally mounted on the frame, the pawl capable of being pivoted between a first position in which the pawl sequentially engages outwardly extending teeth in the ratchet so as to limit rotation of the ratchet in only one direction and a second position in which the pawl disengages from the ratchet to allow for rotation of the ratchet in either of two opposing directions. First, second and third rare earth magnets are mounted in the frame and, in combination with a pair of outwardly projecting ferritic arms provided in the pawl, serve to magnetically bias the pawl into either of its first and second positions.

15 Claims, 9 Drawing Sheets

RATCHETING WINCH WITH A MAGNETICALLY BIASED PAWL

CROSS-REFERENCE TO RELATED APPLICATIONS

The present application claims the benefit under 35 U.S.C. 119(e) of U.S. provisional Patent Application Ser. No. 60/614,936, filed Sep. 30, 2004, the disclosure of which is incorporated herein by reference.

BACKGROUND OF THE INVENTION

The present invention relates generally to winches and more particularly to winches which comprise a rotatable ratchet wheel that can be locked in place using a pivotable pawl.

In the retail industry, it is well known for a length of light to medium gauge wire to be secured at each of its ends to a fixed object, such as a pole, post or wall. With the length of wire held taut between the pair of fixed objects, articles for sale are often hung upon the wire at a considerable height above floor level in order to maximize their visibility. Examples of retail environments in which a length of wire is used to display products for sale include art galleries, trade shows, conventions, and warehouse or wholesale style stores.

It has been found that there is a need for a mechanical device which can be used to perform both of the following functions: (1) to support one end of the length of wire and (2) to provide mechanical means for both tightening the length of wire (in order to more adequately support heavy objects) and loosening the length of wire (in order to lower supported objects to a height which can then be accessed by an employee at floor level).

Accordingly, a winch is a mechanical device which is commonly used in the art to both support one end of a length or wire and mechanically adjust the tautness of said length of wire.

A winch typically includes a rotatable cylindrical drum (also commonly referred to as a spool or spindle) to which one end of the wire is secured, the drum being rotatably mounted on a rigid support frame. A manually operable crank is fixedly coupled to one end of the drum such that, through rotation of the crank, the wire can be wound, or coiled, around the drum, thereby tightening the length of wire. In order to prevent the wire from unwinding from the drum, the winch is typically provided with a ratchet and pawl locking mechanism.

Specifically, a ratchet (also commonly referred to herein as a ratchet wheel) is fixedly mounted on the drum, the ratchet comprising a plurality of outwardly-extending ratchet teeth. In addition, a pawl is pivotally mounted on the support frame for the winch and is typically spring-biased to sequentially engage the teeth of the ratchet to prevent the drum from rotating such that the wire unwinds therefrom, as will be described further in detail below.

In use, a winch of the type described above can be used in the following manner to support one end of a length or wire and to mechanically adjust the tautness of said length of wire. First, the first end of the length of wire is fixedly mounted on a secure object, such as a pole or beam. Then, the second end of the length of wire is connected to the drum of the winch (e.g., by tying the end of the wire to the drum). In turn, the winch is preferably mounted on a support structure, such as a beam, pole or wall.

Supported at both ends onto fixed objects, the length of wire can be tightened in the following manner using the winch. Specifically, using the manually operable crank, the drum is rotated in a first direction which, in turn, causes the second end of the wire to wind around the drum, thereby tightening the length of wire. It should be noted that due to the ratchet-shaped configuration of the teeth on the ratchet wheel, the spring-biased pawl rides along the outer periphery of the ratchet wheel and sequentially deflects away from the tips of the ratchet teeth without impeding rotation of the drum.

Upon withdrawal of the rotational force applied to the drum, the tension within the wire will naturally cause the second end of the wire to unwind from the drum (i.e., cause the drum to rotate in the opposite direction). However, it is to be understood that, upon the initial rotation of the drum in the second direction, the pawl is biased by a spring to engage a tooth on the ratchet wheel so as to impede further rotation. In this manner, the spring-biased pawl serves as a locking device for maintaining the wire taut.

In the situation where the user wishes to loosen the wire (i.e., rotate the drum in the second direction such that the wire can unwind therefrom), the user can apply a rotational force to the pawl (i.e., greater than the internal force of the spring) that causes the pawl to disengage from the ratchet wheel. With the pawl manually disengaged from the ratchet wheel, the tension within the wire will cause the wire to unwind from the drum (i.e., loosen).

Although well known in the art, winches of the type as described above which include a pawl biased by a spring suffer from a couple notable drawbacks.

As a first drawback, winches of the type as described above which utilize a spring for disposing a pawl into selective engagement with a ratchet wheel have been found to be highly unreliable in nature. In particular, over time, the strength of the spring may weaken to the point that the overall functionality of the winch is significantly compromised, which is highly undesirable.

As a second drawback, winches of the type as described above which utilize a spring for disposing a pawl into selective engagement with a ratchet wheel are highly complex mechanical devices (i.e., they include a number of moving mechanical components), thereby rendering said winches relatively costly to manufacture, which is highly undesirable.

SUMMARY OF THE INVENTION

It is an object of the present invention to provide a new and improved winch for controlling the tautness of a light to medium gauge length of wire, or other similar types of lines.

It is another object of the present invention to provide a winch as described above which includes a ratchet wheel that is selectively locked in place by a pivotable pawl.

It is yet another object of the present invention to provide a winch as described above which utilizes non-spring means for biasing the pivotable pawl into selective engagement with the ratchet wheel.

It is yet still another object of the present invention to provide a winch as described above which has a limited number of parts, which is inexpensive to manufacture and which is easy to use.

Accordingly, there is provided a winch for controlling the tautness of a length of wire, said winch comprising (a) a frame, (b) a spindle rotatably mounted on the frame, (c) a ratchet fixedly coupled to the spindle, and (d) a pawl pivotally mounted on the frame, wherein the pawl can be magnetically biased into engagement with the ratchet so as to limit rotation of the ratchet in only one direction.

Various other features and advantages will appear from the description to follow. In the description, reference is made to the accompanying drawings which form a part thereof, and in which is shown by way of illustration, an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
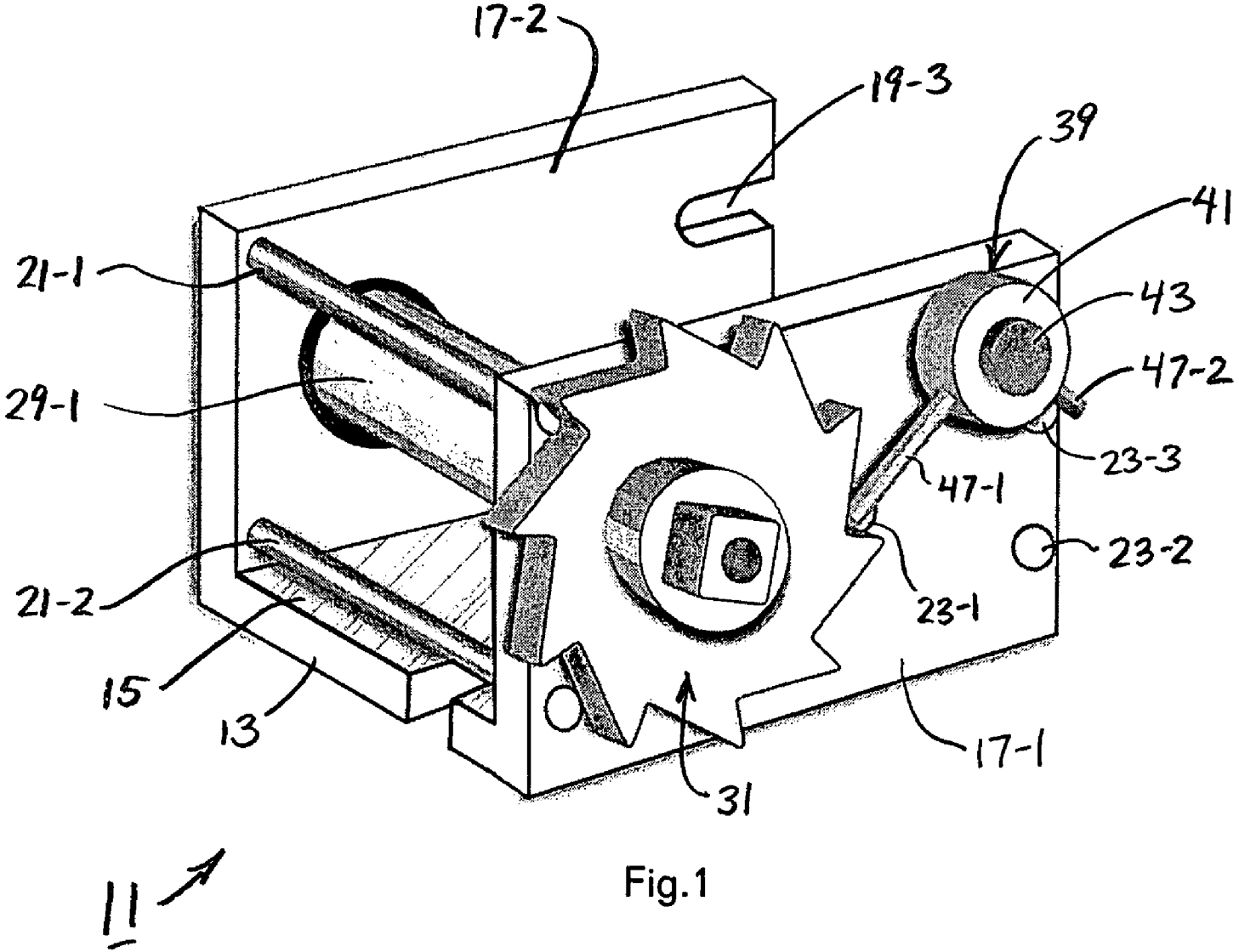
FIG. 1 is a front perspective view of a winch constructed according to the teachings of the present invention.

Referring now to FIGS. 1-5, there are shown perspective, front, rear, top and left end views, respectively, of a novel winch, the winch being constructed according to the teachings of the present invention and identified generally by reference numeral 11. As will be described in detail below, winch 11 can be used to (1) support one end of a length of wire and, with the other end of the wire held fixed in place, (2) provide mechanical means for both tightening and loosening said length of wire.

Winch 11 includes a unitary U-shaped frame 13 which serves as the structural support on which the remaining components for winch 11 are mounted. Frame 13 is preferably constructed out of a rigid and durable material, such as metal, and includes a flat bottom wall 15 and a pair of spaced apart sidewalls 17-1 and 17-2, each sidewall 17 extending generally orthogonally up from the top surface of flat bottom wall 15.

It should be noted that bottom wall 15 is shaped to define a pair of slots 19-1 and 19-2 and sidewall 17-2 is similarly shaped to define a slot 19-3. Together slots 19 enable frame 13 to be fixedly mounted on a plurality of different objects (e.g., a wall, hollow cylindrical pipe, hollow rectangular post or L-shaped bracket) using one or more fastening devices (e.g., a threaded nut and corresponding bolt), which is highly desirable.

Figure 5:
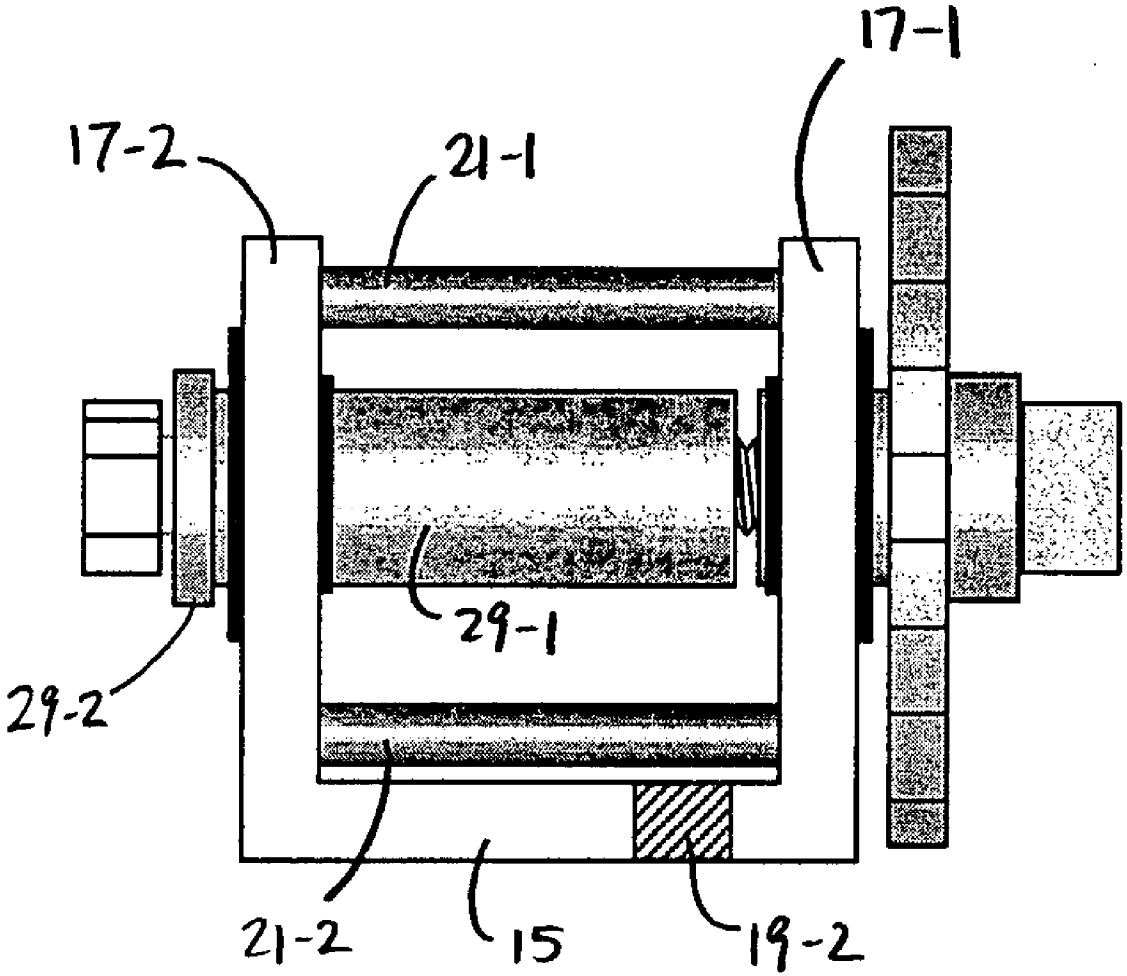
FIG. 5 is a left end view of the winch shown in FIG. 1.

As seen most clearly in FIGS. 1 and 5, a pair of spaced apart wire guiding posts 21-1 and 21-2 extend laterally between sidewalls 17-1 and 17-2. As can be appreciated, guiding posts 21 serve to direct (i.e., control) a length of wire as it is being wound onto winch 11.

Figure 2:
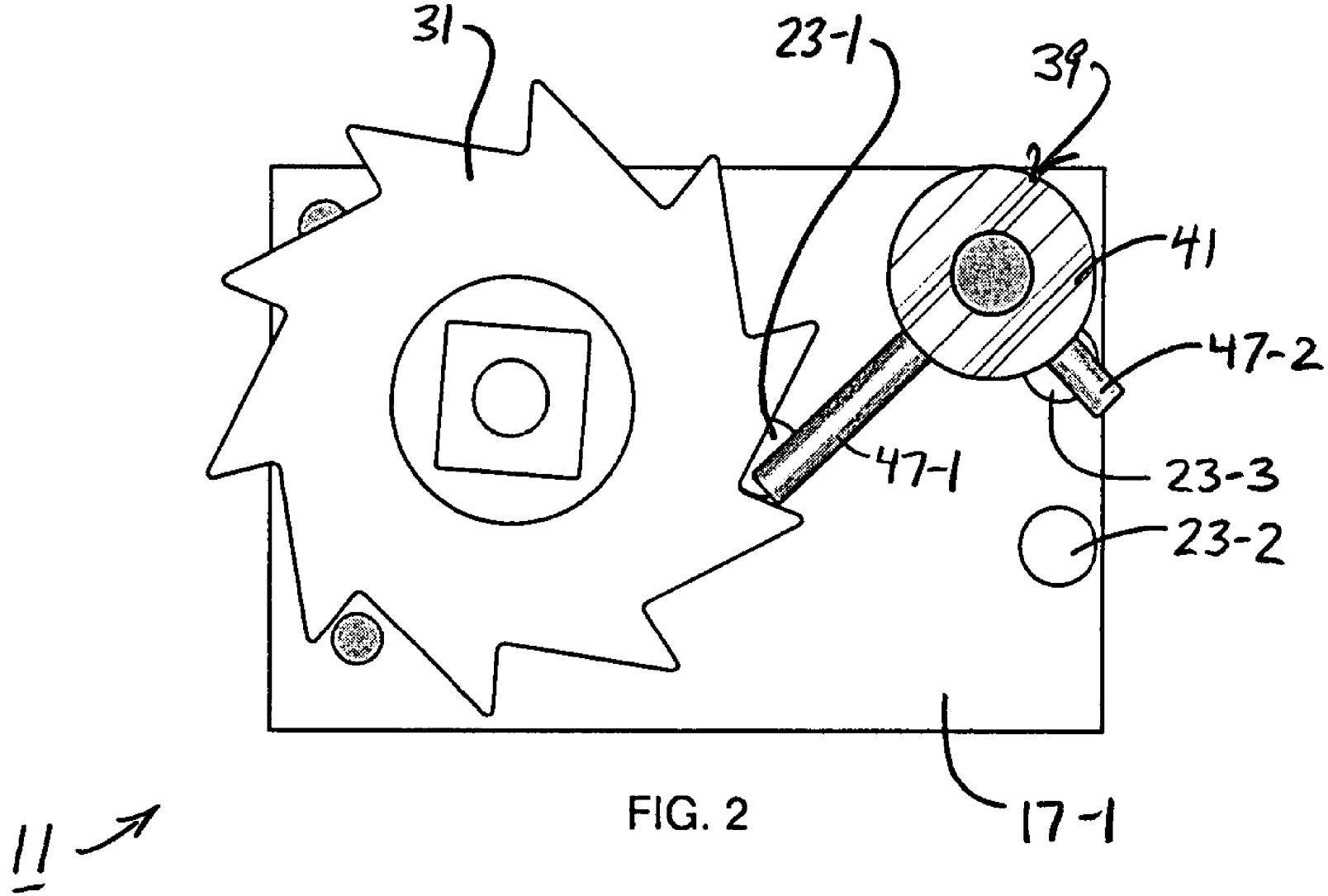
FIG. 2 is a front plan view of the winch shown in FIG. 1.
Figure 3:
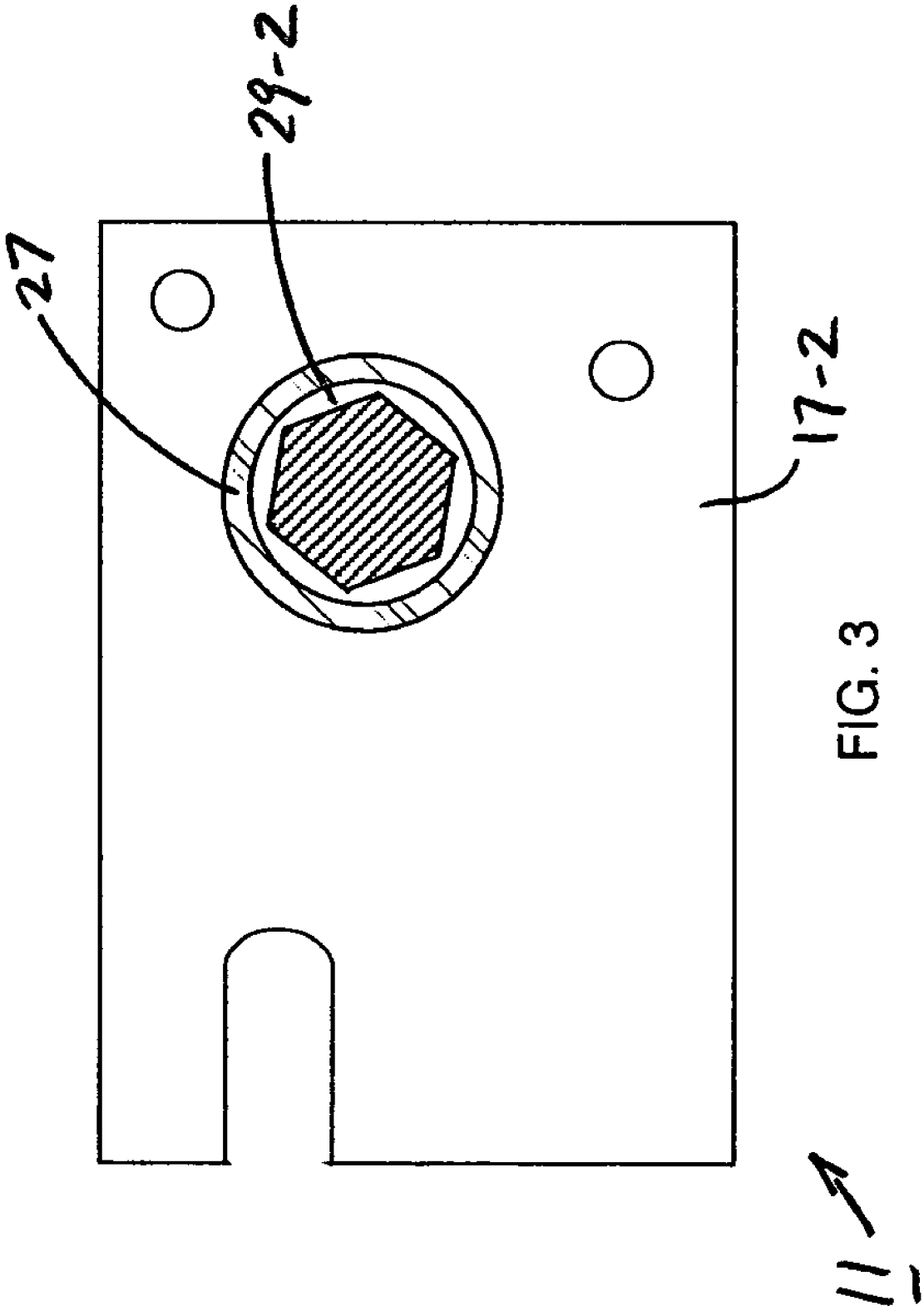
FIG. 3 is a rear plan view of the winch shown in FIG. 1.

As seen most clearly in FIG. 2, first, second and third magnets 23-1, 23-2 and 23-3, respectively, are fixedly mounted in sidewall 17-1 in a particular configuration. Each magnet 23 is preferably circular in shape and is preferably constructed using a rare earth magnet. As will be described further below, the relative positions of magnets 23 serve to magnetically bias a pawl between a first position in which said pawl is disposed into selective engagement with a ratchet wheel and a second position in which said pawl is completely disengaged from said ratchet wheel.

Figure 6:
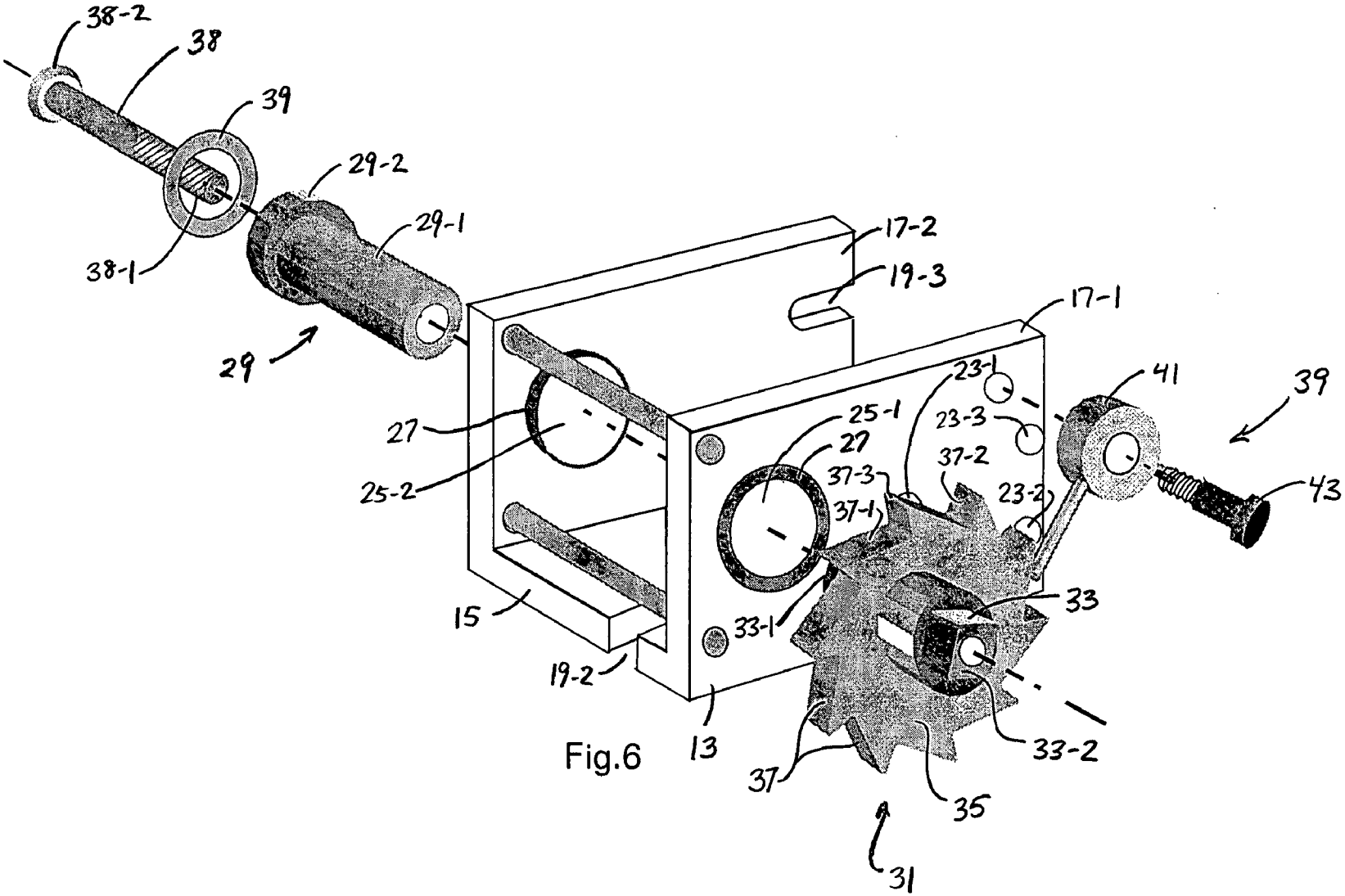
FIG. 6 is a partially exploded perspective view of the winch shown in FIG. 1.

Referring now to FIG. 6, sidewall 17-1 is shaped to define a circular opening 25-1 and sidewall 17-2 is similarly shaped to define a circular opening 25-2, openings 25-1 and 25-2 being co-axially aligned. A low friction thrust washer, or bushing, 27 is press-fit into each opening 25 to preserve the integrity of the frame 13 that immediately surrounds each opening 25 over time (i.e., to prevent frictional wearing away, or galling, of frame 13) as well as to allow for an easy (i.e., lubricant-free) rotation of selected components during use.

Figure 4:
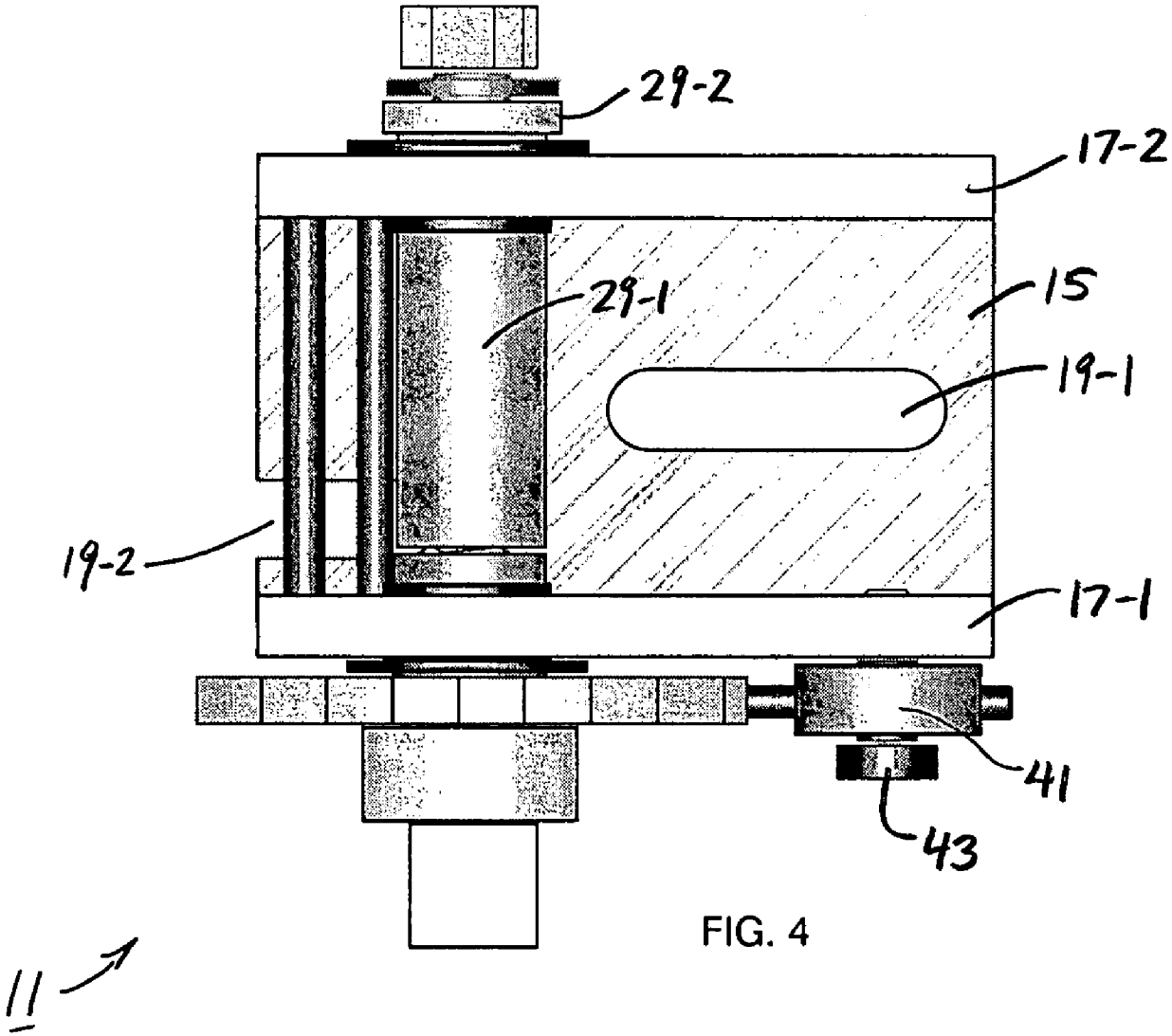
FIG. 4 is a top plan view of the winch shown in FIG. 1.

A hollowed-out, cylindrical spindle 29 is axially disposed through circular opening 25-2 in sidewall 17-2. Spindle 29 (also referred to herein as a drum or spool) includes an elongated wire receiving portion 29-1 (on which a length of wire can be wound as will be described further below) and an enlarged head 29-2. As can be appreciated, spindle 29 is disposed axially inward through opening 25-2 such that portion 29-1 extends from sidewall 17-2 to a point just inside the inner surface of sidewall 17-1, with enlarged head 29-2 having an outer diameter greater than the diameter of opening 25-2 so as limit the inward axial displacement of spindle 29 in the direction towards sidewall 17-1 (i.e., such that head 29-2 of spindle 29 remains on the outside surface of sidewall 17-2), as can be seen in FIGS. 4 and 5.

Referring back to FIG. 6, a unitary ratchet 31 is similarly axially disposed through circular opening 25-1 in sidewall 17-1, ratchet 31 preferably being constructed out of a rigid and durable metal, such as aluminum or a cast alloy. Ratchet 31 includes an elongated, hollowed out, internally-threaded axle 33. Axle 33 includes a first end 33-1 which is generally cylindrically-shaped and which is sized and shaped to be fittingly axially disposed through circular opening 25-1 in sidewall 17-1. Axle 33 additionally includes a second end 33-2 which is generally square-shaped in lateral cross-section, thereby enabling second end 33-2 to be removably coupled with a wrench or other suitable device that can be used as a winch crank arm (not shown).

Ratchet 31 additionally includes a wheel 35 which is located between first end 33-1 and second end 33-2. Wheel 35 includes ten outwardly projecting ratchet-shaped teeth 37 which are equidistantly spaced along its outer periphery, each tooth 37 comprising an elongated tapered surface 37-1 and a shortened abutment surface 37-2 which join together to form an apex, or tip, 37-3, the function of teeth 37 to be described in detail below.

Spindle 29 and ratchet 31 are rotatably mounted on frame 13 in the following manner. Specifically, portion 29-1 of spindle 29 is disposed axially inward through opening 25-2 in sidewall 17-2, with head 29-2 of spindle 29 disposed in contact against the portion of bushing 27 located along the outer surface of sidewall 17-2. Similarly, first end 33-1 of ratchet 31 is disposed axially inward through opening 25-1 in sidewall 17-1, with wheel 35 disposed in contact against the portion of bushing 27 located along the outer surface of sidewall 17-1. Positioned as such, spindle 29 and ratchet 31 are co-axially aligned, as can be seen in FIGS. 4 and 5.

In order to couple spindle 29 and ratchet 31 together, a threaded bolt 38 is used. In particular, bolt 38 is disposed axially through spindle 29 until the threaded first end 38-1 of bolt 38 engages the internal threading within axle 33 of ratchet 31. Furthermore, a washer 39 is mounted along the length of bolt 38 and serves to retain the second end 38-2 of bolt 38 outside of head 29-2. As can be appreciated, by tightening bolt 38 (using a wrench or other suitable instrument), spindle 29 and ratchet 31 are fixedly coupled together and are jointly capable of rotatable displacement relative to frame 13.

As seen most clearly in FIGS. 1, 2, 4 and 6, winch 11 additionally comprises a pivotable pawl 39 which serves to limit rotation of ratchet 31 (and accordingly rotation of spindle 29) in only one direction, as will be described further in detail below. Pawl 39 includes an enlarged circular base 41 which is rotatably mounted onto the outer surface of sidewall 17-2 using a screw 43.

Pawl 39 additionally includes a first and second arms 47-1 and 47-2 which extend out from the outer periphery of circular base 41 approximately 90 degrees apart from one another. Each arm 47 is preferably constructed out of a ferritic material that is naturally magnetically attracted to each magnet 23 in frame 13. In this manner, the magnetic attraction of pawl arms 47 with magnets 23 naturally biases pawl 39 in either of two positions (namely, an engagement position or a disengagement position), as will be described further in detail below.

Operation of Winch 11

Winch 11 can be used in the following manner to both (1) support one end of a display wire and (2) control the tautness of said wire. It should be noted that winch 11 is designed preferably for use with light to medium gauge (approximately 0.030 inches-0.050 inches in diameter) braided microfiber display line and stranded wire. However, alternative types of lines could be utilized in conjunction with winch 11 without departing from the spirit of the present invention.

In the first step, the length of display wire W is fixedly secured at both of its ends. Specifically, a first end (not shown) of display wire W is fixedly mounted onto a support structure. In addition, the second end W1 of display wire W is fixedly coupled to winch 11 in the following manner.

Figure 7B:
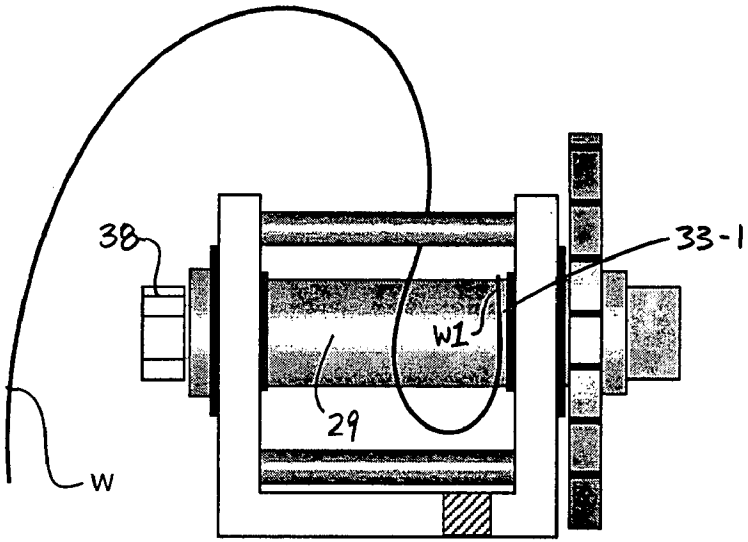
FIGS. 7(*a*)-(*b*) are left end plan views of the winch shown in FIG. 1 at various stages during the process of connecting one end of a wire to the winch.
Figure 7A:
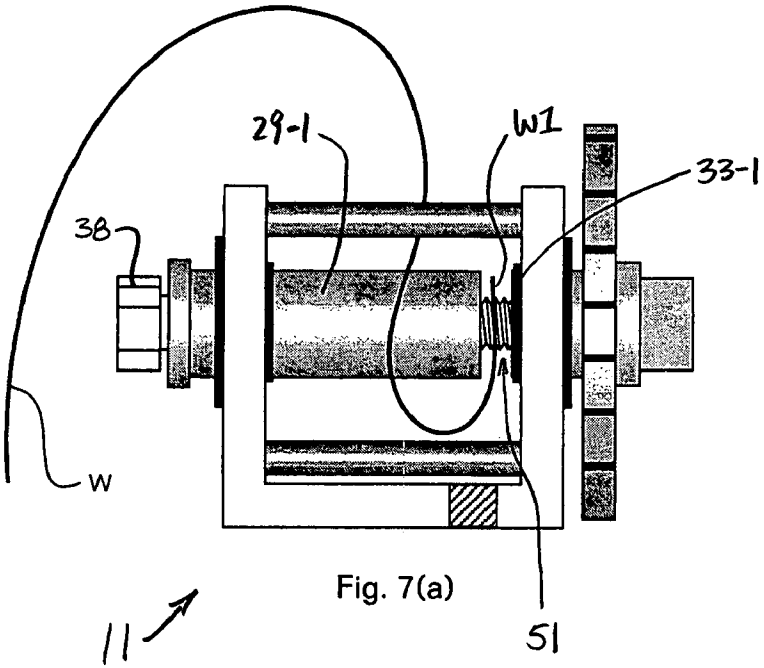
Figure 8B:
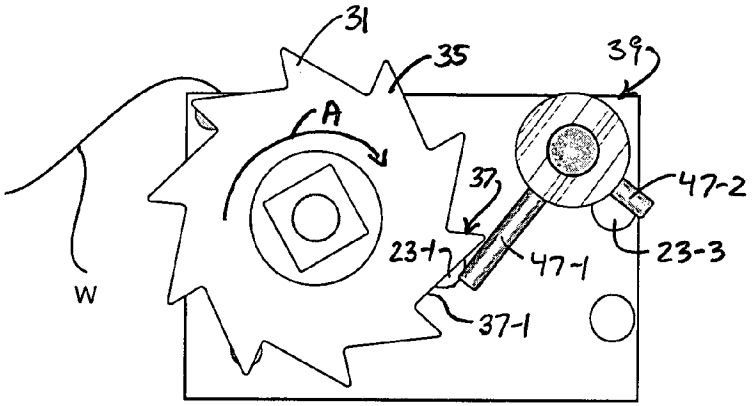
FIGS. 8(*a*)-(*d*) are front plan views of the winch shown in FIG. 1 at various stages during the process of winding one end of the wire onto the spindle.
Figure 8A:
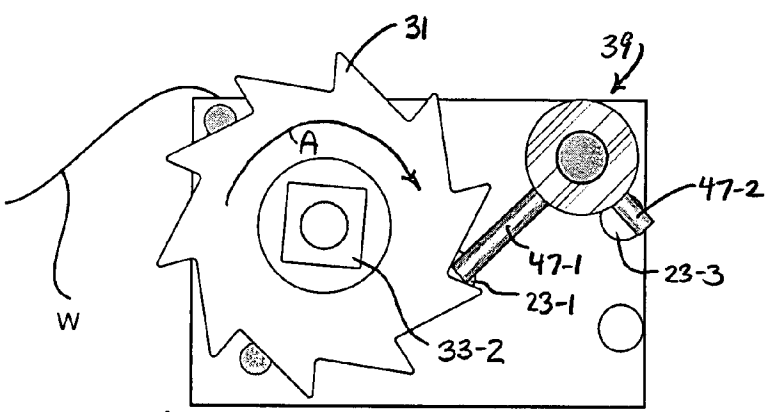
Figure 8D:
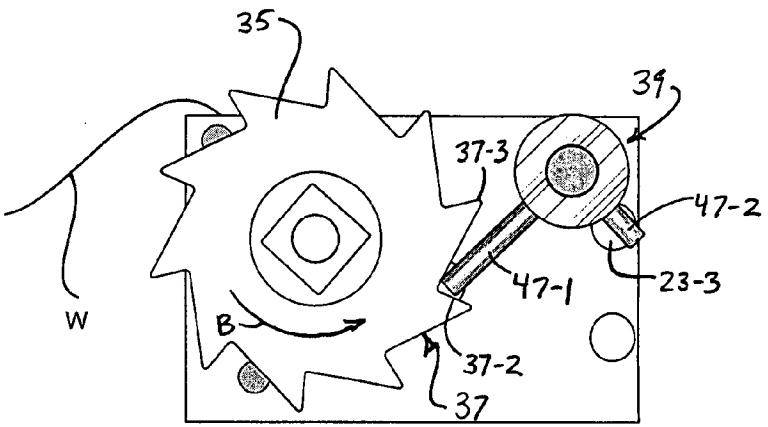
Figure 8C:
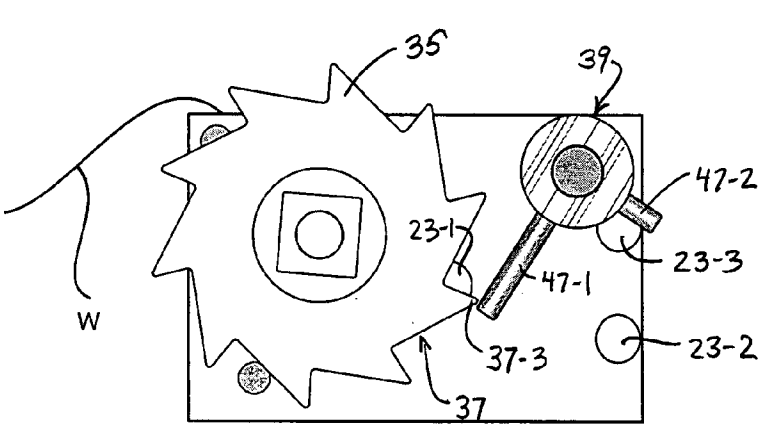

As seen most clearly in FIG. 7(*a*), bolt 38 is loosened using an appropriate instrument (e.g., a box wrench). With bolt 38 substantially loosened, portion 29-1 of spindle 29 and first end 33-1 of ratchet 31 become spaced slightly apart so as to define a narrow annular channel 51 therebetween. The second end W1 of display wire W is then disposed within channel 51 and bolt 38 is tightened once again, as shown most clearly in FIG. 7(*b*), thereby pinching second end W1 of display wire W securely between spindle 29 and first end 33-1 of ratchet 31. In this manner, second end W1 of wire W is effectively coupled to winch 11.

It should be noted that the above-described method for connecting second end W1 of wire W to winch 11 is significantly more simple and effective than traditional means for connecting support wires to prior art winches (e.g., by twisting, knotting and/or crimping one end of a wire to a spool) and therefore serves as a principal novel feature of the present invention.

With second end W1 of display wire W coupled to winch 11, frame 13 of winch 11 is, in turn, mounted onto a support structure, such as a beam, post or wall, using one or more fastening devices. As such, with both ends of display wire W held fixed in place, the intermediate portion of wire W can be used to support various types of articles of commerce (e.g., paintings, tools, etc.).

As seen most clearly in FIG. 8(*a*), in order to tighten the relative tautness of wire W, ratchet 31 is rotated in the clockwise direction (as represented by arrow A in FIG. 8(*a*)) by coupling a wrench or other suitable crank arm (not shown) to second end 33-2 which, in turn, causes wire W to wind around portion 29-1 of spindle 29. As represented in FIG. 8(*a*), the tightening operation is preferably performed with pawl 39 disposed in its first, or engaged, position (i.e., with first arm 47-1 disposed directly above magnet 23-1 and second arm 47-2 disposed directly above magnet 23-3). As seen most clearly in FIG. 8(*b*), as ratchet wheel 35 rotates in the clockwise direction (as represented by arrow A in FIG. 8(*b*)), eventually first arm 47-1 of pawl 39 contacts the elongated tapered surface 37-1 of a ratchet tooth 37. Continued rotation of ratchet wheel 35 in the clockwise direction eventually causes the apex, or tip, 37-3 of ratchet tooth 37 to deflect first arm 47-1 of pawl 39 in the counterclockwise direction (i.e., such that first and second arms 47-1 and 47-2 of pawl 39 are displaced slightly away from magnets 23-1 and 23-3, respectively), as seen most clearly in FIG. 8(*c*). As apex 37-3 of ratchet tooth 37 passes past the length of first arm 47-1, magnets 23-1 and 23-3 magnetically draw first and second arms 47-1 and 47-2, respectively, back to their original position directly thereabove, as shown in FIG. 8(*d*). Disposed as such, it is to be understood that, if wheel 35 were to rotate in the counterclockwise direction (as represented by arrow B in FIG. 8(*d*)), the abutment surface 37-2 for the next sequential tooth 37 would be drawn against the free end of first arm 47-1, thereby precluding any further counterclockwise rotation of wheel 35. In this manner, it should be noted that pawl 39 is magnetically biased to sequentially engage each successive tooth 37 on ratchet wheel 35 in such a manner so as to allow wheel 35 to rotate in the clockwise direction (i.e., to wind-up wire W onto portion 29-1 of spindle 29) but, at the same time, to preclude wheel 35 from rotating in the counterclockwise direction (i.e., to unwind wire W from portion 29-1 of spindle 29).

Figure 9B:
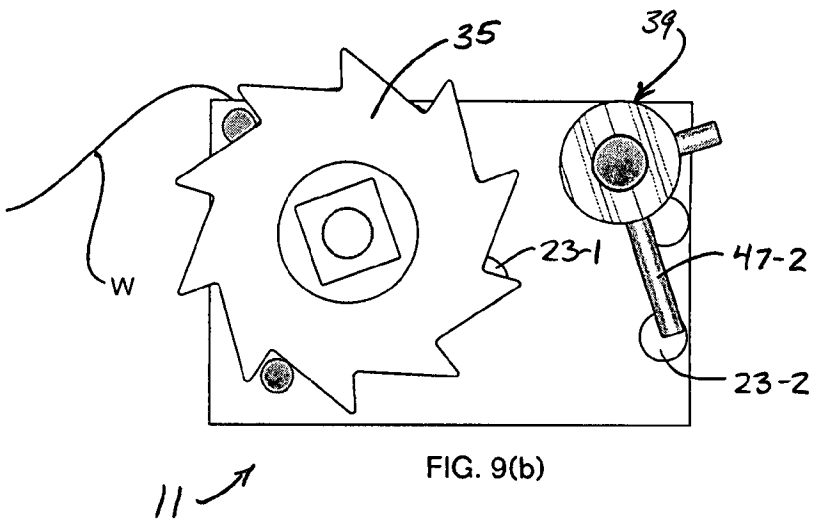
FIGS. 9(*a*)-(*b*) are front plan views of the winch shown in FIG. 1 at various stages during the process of unwinding one end of the wire from the spindle.
Figure 9A:
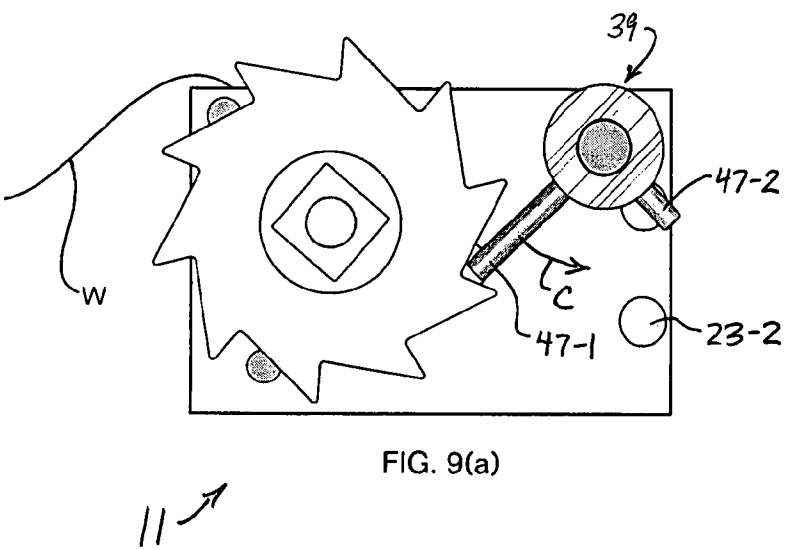

As noted above, with pawl 39 disposed in its first (i.e., engaged) position (as represented in FIG. 9(*a*)), winch 11 can only be used only to tighten the tautness of wire W. However, in order to loosen the tautness of wire W, pawl 39 can be rotated into its second position. Specifically, using second arm 47-2 as a handle, pawl 39 is rotated in the counterclockwise direction, as represented by arrow C in FIG. 9(*a*). In particular, pawl 39 is rotated until first arm 47-1 is disposed directly above magnet 23-2, as seen most clearly in FIG. 9(*b*). Disposed as such, pawl 39 is said to be in its second, or disengaged, position, the magnetic force established between first arm 47-1 and magnet 23-2 serving to lock, pawl 39 in said disengaged position. As can be appreciated, with pawl 39 disposed in its second position, it is readily apparent that wheel 35 is free to rotate in either the clockwise or counterclockwise direction.

It should be noted that the use of magnetic forces (rather than spring forces) to bias pawl 39 into engagement (as well as disengagement) with ratchet 31 serves as a principal novel feature of the present invention. In particular, it should be noted that the use of magnetic biasing means for selectively engaging a ratchet wheel with a pivotable pawl introduces a number of notable advantages over conventional spring biasing means for engaging a ratchet wheel with a pivotable pawl.

As a first advantage, the use of magnetic biasing means for selectively engaging a ratchet wheel with a pivotable pawl renders said winch simpler in its construction and less expensive to manufacture, which is highly desirable.

As a second advantage, the use of magnetic biasing means for selectively engaging a ratchet wheel with a pivotable pawl renders said wench more reliable over time (due to the elimination of unreliable moving mechanical parts), which is highly desirable.

As a third advantage, the use of magnetic biasing means for selectively engaging a ratchet wheel with a pivotable pawl eliminates certain material requirements which, in turn, may render said winch better suited for use in otherwise detrimental conditions (e.g., in a moist environment).

The embodiment shown in the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A winch comprising, (a) frame, (b) a spindle rotatably mounted on the frame, the spindle containing a supply of wound wire, (c) a ratchet fixedly coupled to the spindle for rotable movement with said spindle, the ratchet including a ratchet wheel, (d) a pawl having a first pawl arm made of ferritic material; the pawl being rotably mounted on the frame and being positioned on the frame such that it can be rotated to a first position where the first pawl arm is in engagement with the ratchet wheel so as to limit rotation of the ratchet wheel in only one direction or to a second position where the first pawl arm is out of engagement with the ratchet wheel, (e) a first magnet mounted on the frame and being positioned on the frame for magnetically biasing the first pawl arm into the first position, and (f) a second magnet mounted on the frame and being positioned on the frame for magnetically biasing the first pawl arm into the second position.

2. The winch as claimed in claim 1 wherein each of the first and second magnets are rare earth magnets.

3. The winch as claimed in claim 1 wherein the pawl further comprises a base rotably mounted on the frame, the first pawl arm being fixedly mounted on the base.

4. The winch as claimed in claim 3 wherein the pawl further comprises a second pawl arm fixedly mounted on the base, the second pawl arm being constructed out of ferritic material.

5. The winch as claimed in claim 4 wherein the first and second pawl arms extend out from the base at an approximate right angle relative to one another.

6. The winch as claimed in claim 4 further comprising a third magnet mounted on the frame.

7. The winch as claimed in claim 6 wherein, with the pawl disposed in its first position, a magnetic force is established between the second pawl arm and the third magnet.

8. The winch as claimed in claim 1 wherein the spindle and ratchet are co-axially connected together.

9. The winch as claimed in claim 8 wherein the ratchet includes an internally threaded axle and the winch further includes a threaded bolt for coaxially connecting the spindle and ratchet.

10. The winch as claimed in claim 1 wherein the ratchet wheel, comprises a plurality of outwardly projecting ratchet-shaped teeth along its outer periphery.

11. The winch as claimed in claim 10 wherein each tooth comprises an elongated tapered surface and a shortened abutment surface which join together to form a pointed apex.

12. The winch as claimed in claim 1 wherein the spindle includes an elongated wire receiving portion on which a portion of the wire can be wound.

13. The winch as claimed in claim 1 wherein the frame includes a bottom wall and a pair of upwardly extending sidewalls.

14. The winch as claimed in claim 13 wherein the frame is provided with at least one mounting slot.

15. A winch comprising a frame, a spindle rotably mounted on the frame, a ratchet fixedly coupled to the spindle, the spindle containing a supply of wound wire, the ratchet including a ratchet wheel, a pawl rotably mounted on the frame, the pawl including a first pawl arm made of ferritic material, the pawl being positioned on the frame such that the first pawl arm can be placed in a first position where it is in engagement with the ratchet wheel or a second position where it is out of engagement with the ratchet wheel, a first magnet mounted on the frame and positioned for biasing the first pawl arm into the first position, a second magnet mounted on the frame and positioned for biasing the first pawl arm into the second position a second pawl arm of ferritic material and a third magnet mounted on the frame, the third magnet being positioned on the frame and the second pawl arm being positioned on the pawl such that the second arm is attracted by the third magnet when the first pawl arm is in its first position.

* * * * *